US007996956B2

(12) United States Patent
Wood et al.

(10) Patent No.: US 7,996,956 B2
(45) Date of Patent: Aug. 16, 2011

(54) COLLECTING CHAMBER FOR A CLEANING APPLIANCE

(75) Inventors: Ralph Michael Wood, Bristol (GB); Matthew James Ellam, Wiltshire (GB); Colin Irwin Hare, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 198 days.

(21) Appl. No.: 12/149,341

(22) Filed: Apr. 30, 2008

(65) Prior Publication Data

US 2008/0271284 A1 Nov. 6, 2008

(30) Foreign Application Priority Data

May 3, 2007 (GB) ..... 0708536.8

(51) Int. Cl.
*A47L 9/10* (2006.01)
*A47L 9/20* (2006.01)

(52) U.S. Cl. ..... 15/347; 15/353

(58) Field of Classification Search ..... 15/347, 15/353

See application file for complete search history.

(56) References Cited

U.S. PATENT DOCUMENTS

| | | | | |
|---|---|---|---|---|
| 6,192,550 | B1 * | 2/2001 | Hamada et al. | 15/352 |
| 6,546,593 | B2 * | 4/2003 | Oh et al. | 15/353 |
| 7,134,165 | B2 * | 11/2006 | Pullins | 15/352 |
| 2005/0015921 | A1 * | 1/2005 | Pullins | 15/352 |
| 2005/0229355 | A1 * | 10/2005 | Crouch et al. | 15/352 |
| 2005/0241284 | A1 | 11/2005 | Yoshida et al. | |

FOREIGN PATENT DOCUMENTS

| | | |
|---|---|---|
| CN | 1954757 | 5/2007 |
| EP | 0042723 | 12/1981 |
| EP | 1023864 | 8/2000 |
| EP | 1457150 | 9/2004 |
| EP | 1370173 | 5/2006 |
| EP | 1656871 | 5/2006 |
| EP | 1 779 758 | 5/2007 |
| EP | 1779761 | 5/2007 |
| EP | 1377197 | 5/2008 |
| GB | 2 372 433 A | 8/2002 |
| JP | 58-130650 | 9/1983 |
| JP | 2005-261963 | 9/2005 |
| WO | WO-02/067753 | 9/2002 |
| WO | WO 2004/014209 | 2/2004 |

OTHER PUBLICATIONS

International Search Report and Written Opinion mailed on Sep. 16, 2008 directed towards international application No. PCT/GB2008/001224; 13 pages.

* cited by examiner

*Primary Examiner* — Bryan R Muller
(74) *Attorney, Agent, or Firm* — Morrison & Foerster LLP

(57) ABSTRACT

A cleaning appliance includes a main body and a collecting chamber releasably held on the main body. The collecting chamber includes a closure member which is movable between a closed position and an open position in which the collecting chamber can be emptied and an actuating member adapted and arranged to release the collecting chamber from the main body and, when the collecting chamber is released from the main body, to release the closure member from the closed position. By providing such an arrangement, a single actuating member can be used to release the collecting chamber from the main body of the cleaning appliance and also to open the closure member to empty the collecting chamber. A single actuating member is less complex, requires less space and is more intuitive for a user to operate.

13 Claims, 5 Drawing Sheets

COLLECTING CHAMBER FOR A CLEANING APPLIANCE

REFERENCE TO RELATED APPLICATIONS

This application claims the priority of United Kingdom Application No. 0708536.8, filed May 3, 2007, the contents of which are incorporated herein by reference.

FIELD OF THE INVENTION

The present invention relates to a collecting chamber for a cleaning appliance. Particularly, but not exclusively, the present invention relates to a collecting chamber for a vacuum cleaner.

BACKGROUND OF THE INVENTION

Vacuum cleaners which utilise cyclonic separators are well known. Examples of such vacuum cleaners are shown in EP 0 042 723, EP 1 370 173 and EP 1 268 076. In general, an airflow in which dirt and dust is entrained enters a first cyclonic separator via a tangential inlet which causes the airflow to follow a spiral or helical path within a collecting chamber so that the dirt and dust is separated from the airflow. Relatively clean air passes out of the chamber whilst the separated dirt and dust is collected therein. In some applications, and as described in EP 0 042 723, the airflow is then passed to a second cyclonic separator which is capable of separating finer dirt and dust than the first cyclonic separator. The cleaned airflow then exits the collecting chamber.

The absence of a bag in a cyclonic vacuum cleaner can create difficulties for the disposal of the dirt and dust which is collected by the cleaner. When the collecting chamber of a vacuum cleaner such as that described in EP 0 042 723 becomes full, a user typically removes the collecting chamber from the main body of the machine and tips the collecting chamber upside down. Often it may be necessary for the user to dislodge the dirt manually, which can be inconvenient.

An improved arrangement is disclosed in EP 1 023 864. EP 1 023 864 describes a vacuum cleaner with a collecting chamber which can be removed from a main body of the cleaner for emptying. A lower closure of the dust-collecting chamber is attached by way of a hinge to the remainder of the chamber and the closure can be released by pressing a release button.

However, the arrangement shown in EP 1 023 864 permits the user inadvertently to press the release button whilst the collecting chamber is still attached to the main body. This may result in the lower closure opening as soon as the collecting chamber is lifted away from the main body, spilling dirt and dust from the collecting chamber. EP 1 377 197 discloses a vacuum cleaner in which the operation of the release button is inhibited when the collecting chamber is stored on the main body of the vacuum cleaner. This is achieved by providing a barrier which physically prevents the user from operating the release button when the collecting chamber is stored on the main body.

Whilst useful, the arrangements disclosed in EP 1 023 864 and EP 1 377 197 each involve separate mechanisms to release the collecting chamber from the vacuum cleaner and to open the lower closure for emptying purposes. Multiple mechanisms such as these require space, additional parts and can be more difficult for a user to operate.

SUMMARY OF THE INVENTION

Therefore, it is an object of the invention to provide a simpler and more convenient actuating mechanism to enable a user to empty a collecting chamber of a vacuum cleaner.

According to the invention, there is provided a cleaning appliance comprising a main body and a collecting chamber releasably held on the main body, the collecting chamber comprising a closure member which is movable between a closed position and an open position in which the collecting chamber can be emptied, wherein the collecting chamber further comprises an actuating member adapted and arranged to release the collecting chamber from the main body and, when the collecting chamber is released from the main body, to release the closure member from the closed position.

By providing such an arrangement, a single actuating member can be used to release the collecting chamber from the main body of the cleaning appliance and also to open the closure member to empty the collecting chamber. A single actuating member is less complex, requires less space and is easier for a user to operate.

This arrangement only enables the release of the closure member when the collecting chamber has been released from the main body. This prevents accidental opening of the closure member whilst the collecting chamber is located on the main body, which may result in unwanted spillage of dirt and dust and may affect the performance of the cleaning appliance.

Preferably, the actuating member forms part of a catch which holds the collecting chamber on the main body. This arrangement enables the actuating member to be operable to release the collecting chamber from the main body of the cleaning appliance.

Preferably, the actuating member comprises a first part which forms part of the catch and includes a user-operable button, and a second part which is adapted and arranged to release the closure member. More preferably, the actuating member further comprises a displaceable member which, in a first position, couples the first and second parts of the actuating member, and in a second position, decouples the first and second parts. This arrangement allows the two functions of the actuating member to be decoupled, depending upon the environment or location of the collecting chamber, i.e. whether held on the main body or remote from the main body.

Preferably, when the collecting chamber is held on the main body, a part of the main body is adapted and arranged to displace the displaceable member from the first position to the second position. More preferably, the displaceable member is rotatable between first and second positions. This arrangement is a simple and convenient way of providing a movable displaceable member.

Alternatively, the displaceable member is deformable between first and second positions. The displaceable member may be deformed by a part of the main body in order to move the displaceable member from the first position to the second position. Such an arrangement requires few components and is simple to manufacture.

BRIEF DESCRIPTION OF THE DRAWINGS

An embodiment of the invention will now be described with reference to the accompanying drawings, in which.

DETAILED DESCRIPTION OF THE INVENTION

Figure 1:
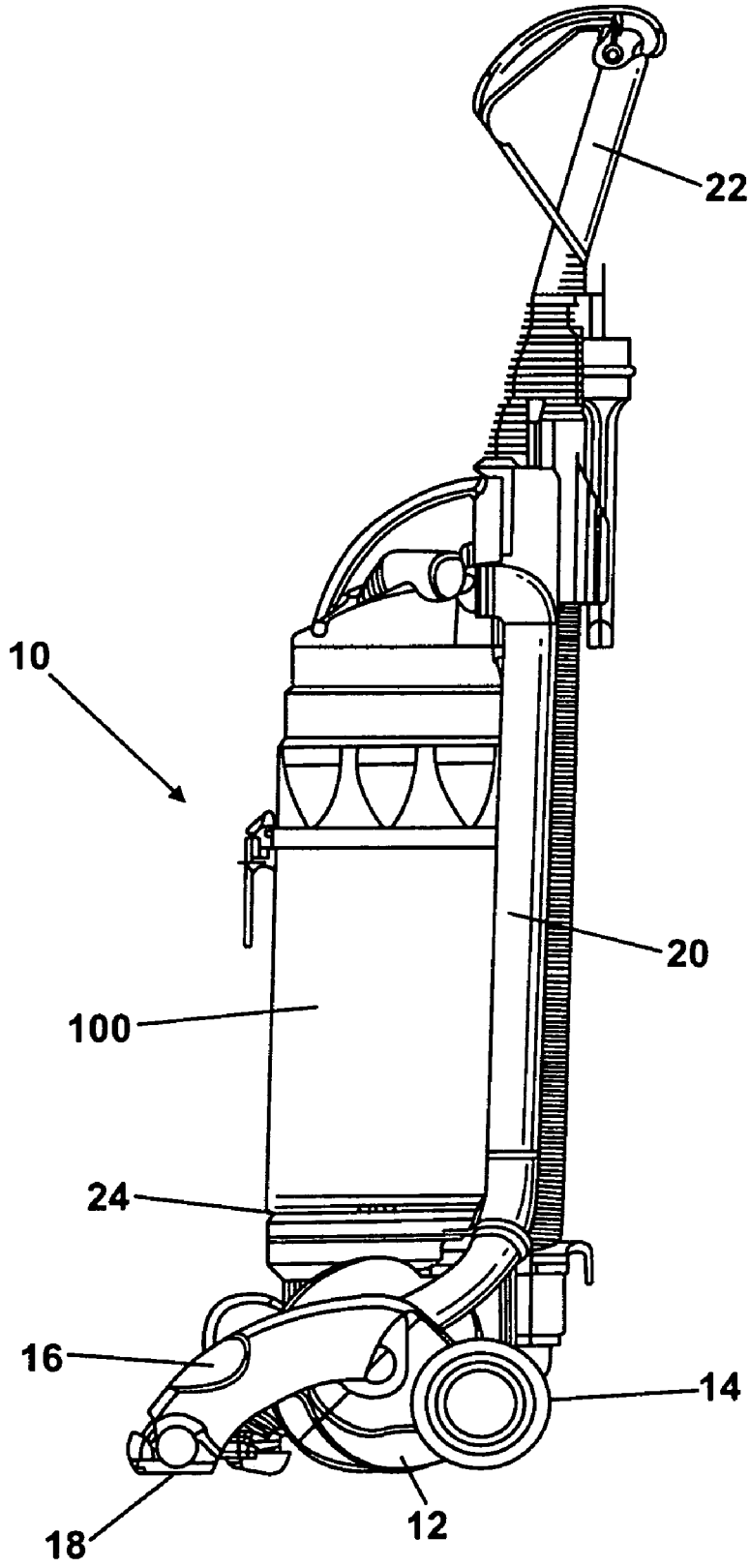
FIG. 1 shows an upright vacuum cleaner incorporating a collecting chamber according to the invention.

FIG. 1 shows an upright vacuum cleaner 10 having a main body 12 which includes a motor and fan unit (not shown) and a pair of wheels 14. A cleaner head 16 is pivotably mounted on the lower end of the main body 12 and a dirty air inlet 18 is provided in the underside of the cleaner head 16 facing the floor surface. The main body 12 further includes a spine 20 which extends vertically upward and merges into a handle 22. The handle 22 can be manipulated by a user to manoeuvre the vacuum cleaner 10 across a floor surface. The main body 12 further includes a plurality of outlet ports 24 for exhausting air from the vacuum cleaner 10.

A collecting chamber 100 is releasably held on the main body 12. The collecting chamber 100 is supported on the main body 12 above the outlet ports 24 and lies adjacent the spine 20. The interior of the collecting chamber 100 is in communication with the dirty air inlet 18 through ducting in the spine 20. The collecting chamber 100 can be removed from the main body 12 for emptying purposes.

In use, the motor and fan unit draws dirty air into the vacuum cleaner 10 via the dirty air inlet 18. The dirty air is carried to the collecting chamber 100 via the ducting in the spine 20 and entrained dirt and dust is separated from the airflow and retained in the collecting chamber 100. The cleaned air is passed across the motor for cooling and then ejected from the vacuum cleaner 10 via the outlet ports 24.

Figure 2:
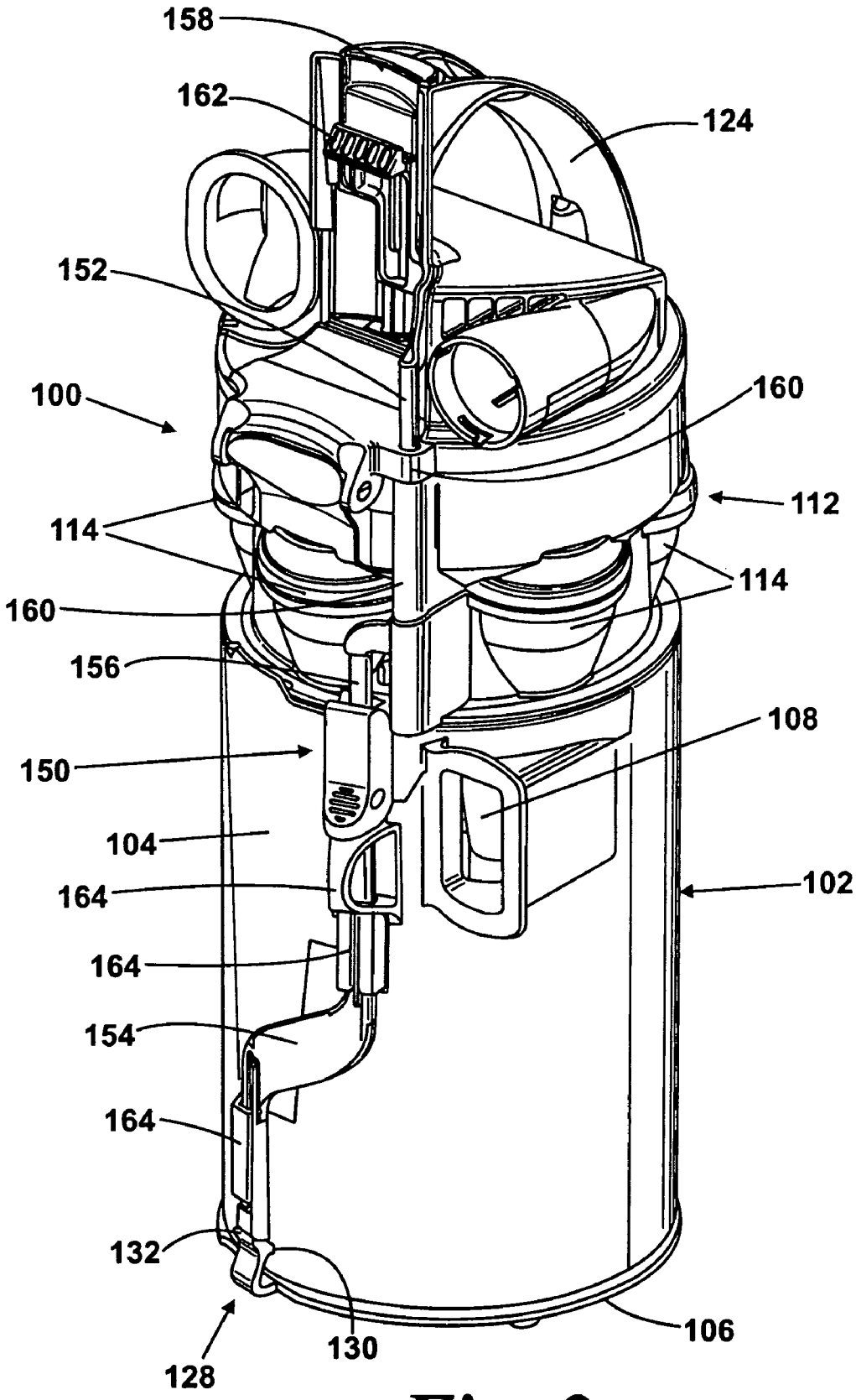
FIG. 2 is an isometric view of the collecting chamber according to the invention removed from the remainder of the upright vacuum cleaner of FIG. 1.
Figure 3:
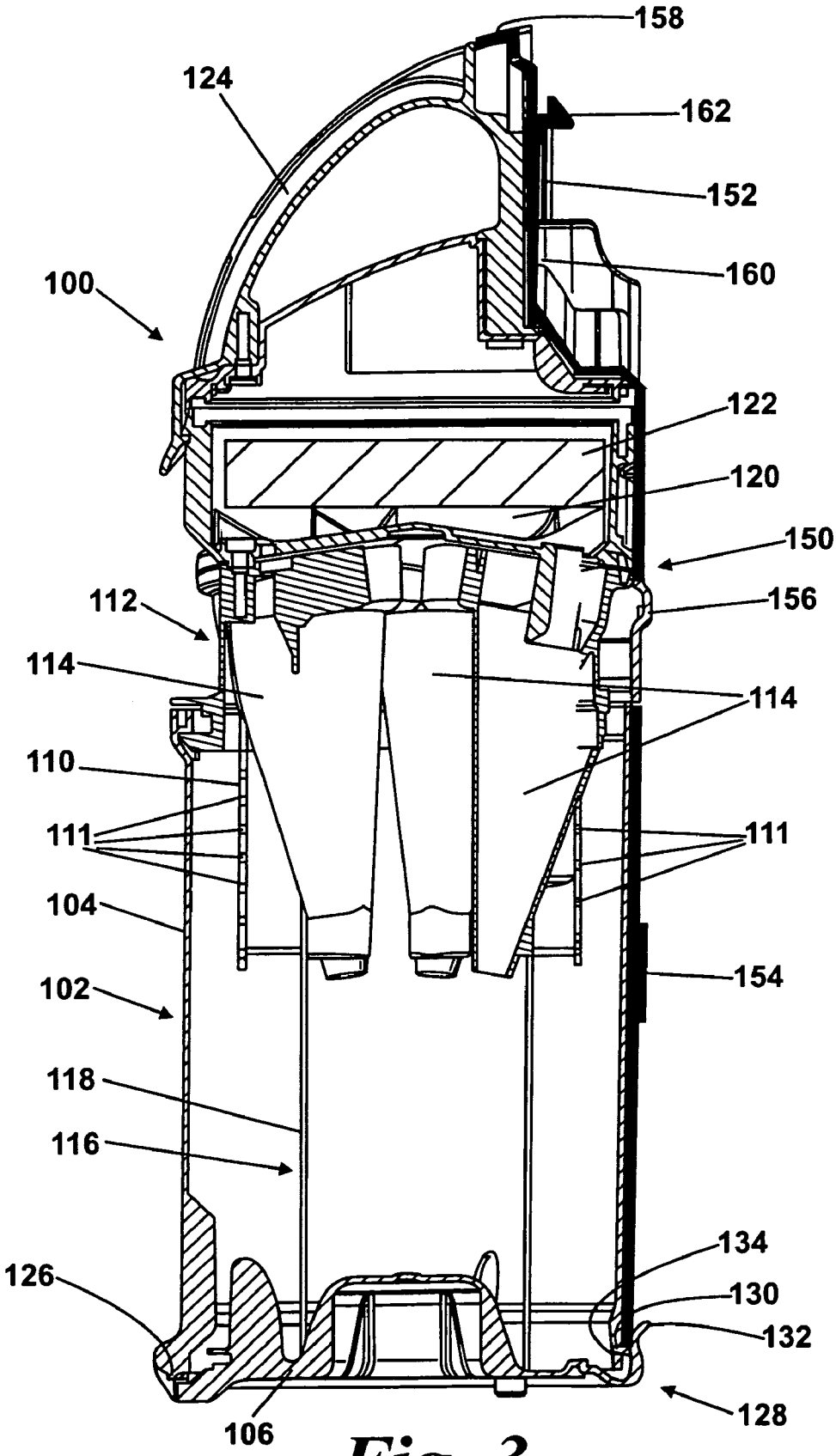
FIG. 3 is a section through the collecting chamber of FIG. 2 showing the base of the collecting chamber in a closed position.

FIGS. 2 and 3 show the collecting chamber 100 in more detail. The collecting chamber 100 includes an upstream cyclone 102 having a cylindrical side wall 104 and a base 106. An air inlet 108 is formed in the cylindrical side wall 104. When the collecting chamber 100 is held on the main body 12 of the vacuum cleaner 10, the air inlet 108 is in communication with the dirty air inlet 18 and forms a communication path between the ducting in the spine 20 and the interior of the upstream cyclone 102. The air inlet 108 is arranged tangentially to the upstream cyclone 102 so that the incoming air is encouraged to follow a helical path around the interior of the upstream cyclone 102.

A shroud 110 is located inwardly of the cylindrical wall 104 of the upstream cyclone 102. The shroud 110 comprises a cylindrical wall having a plurality of through-holes 111. The shroud 110 provides a communication path between the upstream cyclone 102 and a downstream cyclone assembly 112.

The downstream cyclone assembly 112 comprises a plurality of downstream cyclones 114 arranged in parallel. In this embodiment, five downstream cyclones 114 are provided. Each downstream cyclone 114 is in communication with a downstream collector 116 having a collector wall 118 located inwardly of the shroud 110. Dirt and dust separated by the downstream cyclones 114 is deposited in the downstream collector 116. Each of the downstream cyclones 114 is also in communication with a duct 120. The duct 120 provides an airflow path from the collecting chamber 100 into other parts of the vacuum cleaner 10. A pre-motor filter 122 is located in the duct 120. The pre-motor filter 122 comprises a porous material such as a foam.

A handle 124 is located above the duct 120 and is arranged to allow a user to carry the collecting chamber 100. If the collecting chamber 100 is held on the main body 12 of the vacuum cleaner 10 (as shown in FIG. 1) then the handle 124 may also be used to carry the vacuum cleaner 10.

The base 106 closes one end of the upstream cyclone 102. The base 106 is pivotably mounted on the lower end of the cylindrical wall 104 by means of a hinge 126. The base 106 is retained in a closed position (as shown in FIGS. 2 and 3) by means of a catch 128 located on the base 106. The catch 128 includes a lug 130 and a flange 132. The lug 130 is received by a cooperating groove 134 formed in the external surface of the cylindrical wall 104. The catch 128 is formed from a resilient material which biases the lug 130 into the groove 134 when the base 106 is in the closed position.

The collecting chamber 100 further includes an actuating member 150. The actuating member 150 comprises a first part 152, a second part 154 and a displaceable member 156. The first part 152 is arranged at the upper end of the collecting chamber 100 and has a user-operable button 158 located at an upper end. The button 158 is located at an upper end of the handle 124 and is biased upwardly by a spring (not shown). The first part 152 is arranged to be slideably movable relative to the collecting chamber 100 by depression of the button 158 against the bias of the spring. The first part 152 is supported by guides 160 (FIG. 2).

The first part 152 also includes a catch 162. The catch 162 is formed integrally with the upper end of the first part 152 and is able to slide vertically up/down therewith. The catch 162 is arranged to engage with a catch face on the main body 12 of the vacuum cleaner 10. This will be described later.

The second part 154 is located on the external surface of the cylindrical wall 104 and is supported by a plurality of guides 164 (FIG. 2). A spring (not shown) biases the second part 154 upwardly. When moved downwardly, the lowermost end of the second part 154 is operable to engage the flange 132 and push the lug 130 out of the groove 134 to release the base 106. This will be described later.

The displaceable member 156 is located between the first and second parts 152, 154 of the actuating member 150. The displaceable member 156 has a dog leg shape (FIG. 2) and is rotatably coupled to one end of the first part 152. The rotatable coupling between the first part 152 and the displaceable member 156 allows the displaceable member 156 to rotate about a substantially vertical axis. The dog leg shape of the displaceable member 156 enables the lowermost part of the displaceable member 156 to rotate between a first position in which the displaceable member 156 couples the first and second parts 152, 154, and a second position in which the displaceable member 156 is spaced from the second part 154 so that the first and second parts 152, 154 are decoupled. A spring (not shown) biases the displaceable member 156 towards the first position.

In other words, when the displaceable member 156 is in the first position, the whole of the actuating member 150 (including the first part 152, the second part 154 and the displaceable member 156) moves slideably within the guides 160, 164 when the button 158 is pressed. When the displaceable member 156 is in the second position, only the first part 152 and the displaceable member 156 move slideably within the guides 160 when the button 158 is pressed.

Figure 4:
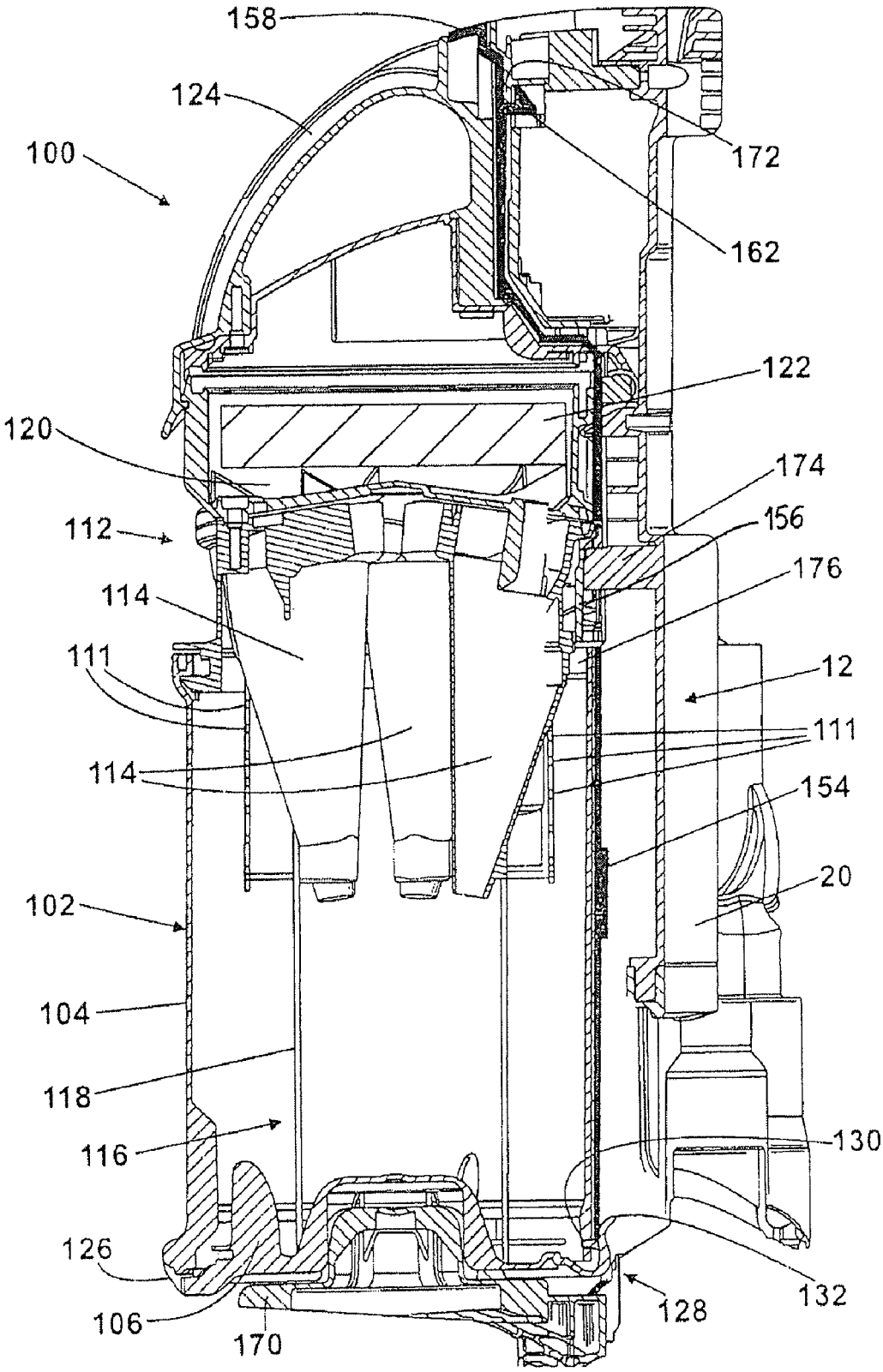
FIG. 4 is a section through the collecting chamber of FIG. 2 showing the collecting chamber located on the main body of the upright vacuum cleaner of FIG. 1.

FIG. 4 shows the collecting chamber 100 located on the main body 12 of the vacuum cleaner 10. When held on the main body 12, the collecting chamber 100 is supported by a base 170 of the main body 12 and is located adjacent the spine 20 of the vacuum cleaner 10. The catch 162 is arranged to engage with a catch face 172 formed in the spine 20 adjacent the collecting chamber 100. When the catch 162 is engaged with the catch face 172 on the main body 12 of the vacuum cleaner 10, the entire vacuum cleaner 10 can be lifted by the handle 124 of the collecting chamber 100.

The spine 20 of the vacuum cleaner comprises a projection 174 which projects into the space between the spine 20 and the collecting chamber 100. When the collecting chamber 100 is held on the main body 12, the projection 174 is arranged to engage with the displaceable member 156 and to move the displaceable member 156 from the first position to the second position. In the second position, the lowermost end of the displaceable member 156 is spaced from the second part 154 and is located above a cavity 176. If the button 158 is pressed whilst the displaceable member 156 is in the second position, the lowermost end of the displaceable member 156 will enter the cavity 176, thereby decoupling the first and second parts 154, 156 and preventing the base 106 from being opened. The displaceable member 156 will remain trapped in the cavity 176 until the button 158 is released.

In use, the motor and fan unit (not shown) draws a flow of dirt-laden air into the dirty air inlet 18 and into the collecting chamber 100. Dirt-laden air enters the collecting chamber 100 through the air inlet 108. Due to the tangential arrangement of the air inlet 108, the airflow is encouraged to follow a helical path around the interior of the wall 104. Larger dirt and dust particles are separated by cyclonic motion around the wall 104. These particles are then collected at the base 106 of the upstream cyclone 102.

The partially-cleaned airflow then flows back up the interior of the upstream cyclone 102, exits the upstream cyclone 102 via the through-holes 111 in the shroud 110 and passes into the downstream cyclone assembly 112. Each of the downstream cyclones 114 forming part of the downstream cyclone assembly 112 has a diameter smaller than that of the upstream cyclone 102. Therefore, the downstream cyclones 114 are able to separate smaller particles of dirt and dust from the partially-cleaned airflow than the upstream cyclone 102. Separated dirt and dust exits the downstream cyclones 114 and passes into the downstream collector 128.

Cleaned air then flows back up through the downstream cyclones 114 and enters the duct 120. The cleaned air then passes from the duct 120 sequentially through the pre-motor filter 122, the motor and fan unit, and a post-motor filter (not shown) before being exhausted from the vacuum cleaner 10 through the outlet ports 24.

When a cleaning operation is finished, the collecting chamber 100 may require emptying. To do this, the user releases the collecting chamber 100 from the main body 12 by depressing the button 158. This pushes the first part 152 and the displaceable member 156 downwardly. The catch 162 moves downwardly and disengages from the catch face 172, releasing the collecting chamber 100. At the same time, the displaceable member 156 (which is biased into the second position by engagement with the projection 174) enters the cavity 176. The second part 154 does not move downwardly because, in the second position, the displaceable member 156 is spaced from the second part 154 of the actuating member 150. Therefore, the user can remove the collecting chamber 100 from the main body 12 with no risk of the base 106 being pushed open. Once the collecting chamber 100 has been removed from the main body, the button 158 can be released. The user can then place the collecting chamber 100 over a suitable dirt and dust receptacle such as a dustbin.

Figure 5:
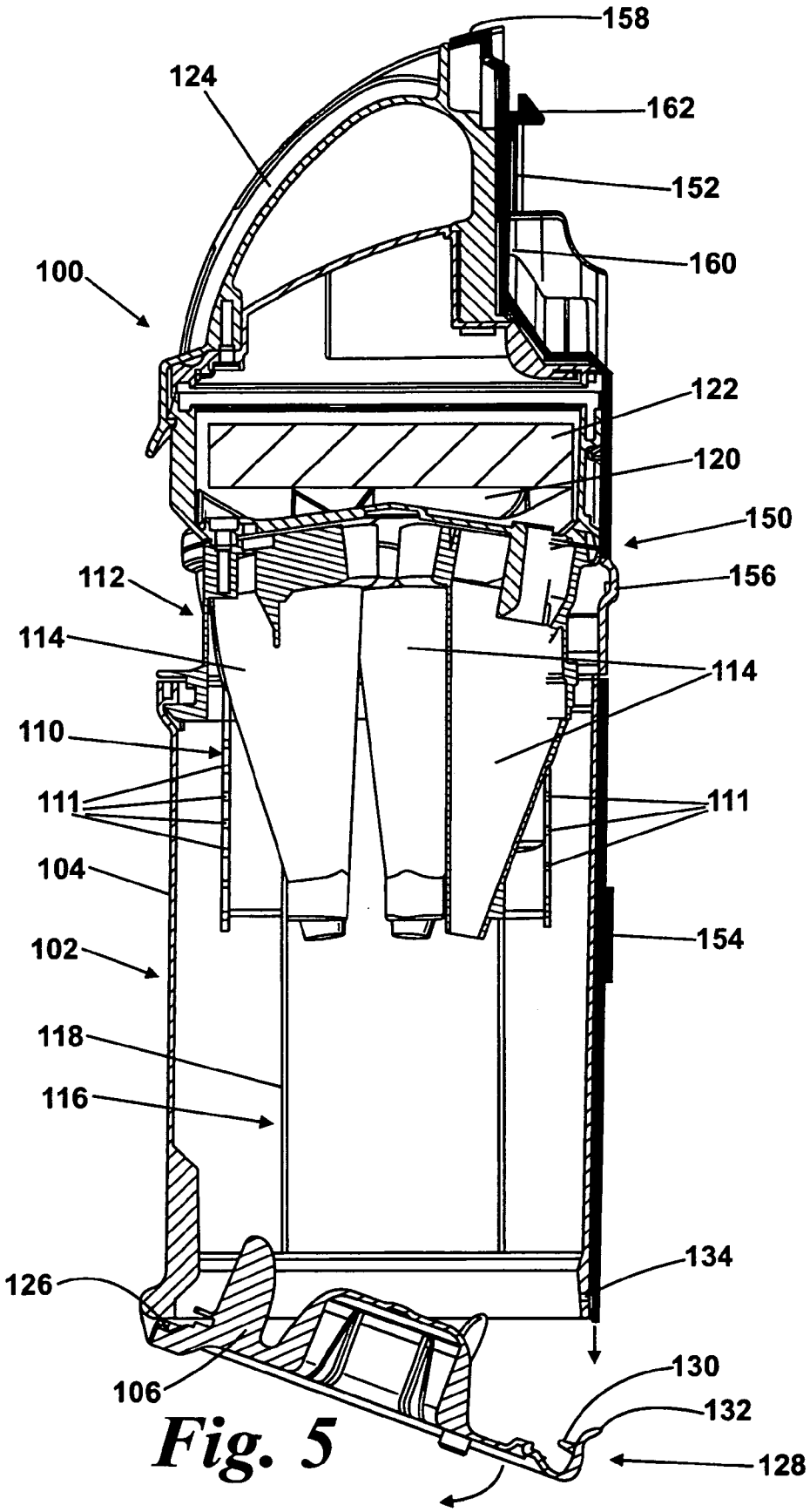
FIG. 5 is a section through the collecting chamber of FIG. 2 showing the base of the collecting chamber in an open position.

When the button 158 is released, the first part 152 and the displaceable member 156 move upwardly under the bias of the spring. The displaceable member 156 moves out of the cavity 176 and the spring biases the displaceable member 156 into the first position. Thus, when the user pushes the button 158 again, the displaceable member 156 is in the first position (and therefore in alignment with the second part 154) and so the second part 154 moves downwardly against the catch 128. The lower end of the second part 154 engages the flange 132 and pushes the lug 130 out of the groove 134. This releases the base 106, pushing the base 106 away from the wall 104 and allowing the base 106 to pivot downwardly about the hinge 126 as shown in FIG. 5. The dirt and dust collected in the collecting chamber 100 can thus be emptied conveniently and efficiently. The upstream cyclone 102 and the downstream collector 116 are emptied simultaneously during this process.

When the collecting chamber 100 has been emptied as described above, the user may close the collecting 100 by manually moving the base 106 back into the closed position shown in FIGS. 2 and 3. The collecting chamber 100 can then be replaced on the main body 12 of the vacuum cleaner 10 (as shown in FIG. 4) for further cleaning operations.

The invention is not limited to the detailed description given above. Variations will be apparent to the person skilled in the art. For example, the displaceable member need not be rotatable between the first and second positions. A resilient displaceable member may be used so that, when a part of the main body of the vacuum cleaner engages with the displaceable member, the displaceable member is deformed. This deformation prevents the displaceable member from coupling with the second part of the actuating member.

Any suitable resilient means could be used for the displaceable member. Plastics such as nylon or ABS could be used. Alternatively, rubbers or metallic strips may be used. The displaceable member may be deformed so that it is pushed away from the second part. Alternatively, the displaceable member may be urged into a buckled or compressed arrangement so that it cannot transmit force between the first and second parts of the actuating member. Other arrangements may be used; what is important is that the displaceable member is able to move between first and second positions in which the first and second parts are coupled and decoupled respectively.

The separating apparatus need not be a cyclonic separator. Other forms of separating apparatus could be used, for example, a porous bag or filter. Additionally, the separating apparatus need not be located in the collecting chamber. A separate collecting chamber may be provided. What is important is that the collecting chamber collects dirt and dust which is then emptied by the user.

A part of the collecting chamber other than the base of the collecting chamber may be movable for emptying purposes. Other forms, arrangements and locations of closure members may be used. For example, the side or top of the collecting chamber may be movable. Further, the closure member need not be pivotable. Other opening arrangements for the closure member may be used; for example, sliding, retracting or rotating closure members.

The cleaning appliance need not be an upright vacuum cleaner. The invention is applicable to other types of vacuum cleaner, for example, cylinder machines, stick-vacuums or hand-held cleaners. Further, the present invention is applicable to other types of cleaning appliances, for example, a wet and dry machine or a carpet shampooer.

The invention claimed is:

1. A cleaning appliance comprising:

a main body, and a collecting chamber releasably held on the main body, the collecting chamber comprising, a closure member which is movable between a closed position and an open position in which the collecting chamber can be emptied, and an actuating member comprising a user operable button, wherein the user operable button is depressible toward a bottom of the collecting chamber to release the collecting chamber from the main body when the collecting chamber is held on the main body, and wherein the user operable button is depressible toward a bottom of the collecting chamber to release the closure member from the closed position when the collecting chamber is not held on the main body.

2. A cleaning appliance as claimed in claim 1, wherein the actuating member forms part of a catch which holds the collecting chamber on the main body.

3. A cleaning appliance as claimed in claim 2, wherein the actuating member comprises a first part which forms part of the catch and includes a user-operable button, and a second part which is adapted and arranged to release the closure member.

4. A cleaning appliance as claimed in claim 3, wherein the actuating member further comprises a displaceable member which, in a first position, couples the first and second parts of the actuating member, and in a second position, decouples the first and second parts.

5. A cleaning appliance as claimed in claim 4, wherein the main body comprises a projection to displace the displaceable member from the first position to the second position when the collecting chamber is held on the main body.

6. A cleaning appliance as claimed in claim 4, wherein the displaceable member is rotatable between the first and second positions.

7. A cleaning appliance as claimed in claim 3, wherein the closure member further comprises a catch and the second part is adapted and arranged to urge the catch to release the closure member when the actuating member is operated when the collection chamber is removed from the main body.

8. A cleaning appliance as claimed in any one of the preceding claims, wherein the cleaning appliance is a vacuum cleaner.

9. A cleaning appliance as claimed in claim 8, wherein the vacuum cleaner incorporates a cyclonic separator.

10. A cleaning appliance as claimed in claim 9, wherein the cyclonic separator comprises an upstream cyclone separator having an upstream collector and a downstream cyclone separator having a downstream collector, both collectors being arranged within the collecting chamber.

11. A cleaning appliance as claimed in claim 10 wherein deposited dirt and dust within the each of the upstream and downstream collectors can be emptied simultaneously when the closure member is released.

12. A cleaning appliance comprising:

a main body, and a collecting chamber releasably held on the main body, the collecting chamber comprising, a closure member which is movable between a closed position and an open position in which the collecting chamber can be emptied, and a depressible member, wherein the depressible member is depressible in a fixed direction to release the collecting chamber from the main body when the collecting chamber is held on the main body, and wherein the depressible member is depressible in the same fixed direction to release the closure member from the closed position when the collecting chamber is not held on the main body.

13. A cleaning appliance comprising:

a main body comprising a displacement projection, and a collecting chamber releasably held on the main body, the collecting chamber comprising, a closure member which is movable between a closed position and an open position in which the collecting chamber can be emptied, an actuating member which is depressible both to release the collecting chamber from the main body and, when the collecting chamber is released from the main body, to release the closure member from the closed position, and a connecting device, comprising a first part, a second part, and a displaceable member located between the first part and the second part, wherein a first distal end of the first part of the connecting device is proximate to the actuating member and a second distal end of the first part of the connecting device is proximate to the displaceable member, and a first distal end of the second part of the connecting device is proximate to the displaceable member and a second distal end of the second part of the connecting device is proximate the closure member, wherein when the collecting chamber is not held on the main body, the displaceable member is configured to transmit a downward force applied to the first part of the connecting device by the actuating member to the second part of the connecting device, which then applies the force to release the closure member, and wherein when the collecting chamber is held on the main body, the displacement projection contacts and displaces the displaceable member to prevent the downward force from being transmitted from the first part of the connecting device to the second part of the connecting device, and to thereby prevent the closure member from being released when the actuating member is depressed.

* * * * *